US005242546A

United States Patent [19]

Evans et al.

[11] Patent Number: 5,242,546

[45] Date of Patent: Sep. 7, 1993

[54] HIGH GRADE POLYETHYLENE PAPER

[75] Inventors: Robert J. Evans, Clarkston, Mich.; Homan B. Kinsley, Jr., Powhatan, Va.; Gurvinder P. S. Kochar, Midlothian, Va.; Chi C. Lee, Richmond, Va.; Karl M. Martin, Richmond, Va.; Silas S. Shelburne, Jr., Richmond, Va.; Richard B. Smith, Richmond, Va.; James R. Waggoner, Midlothian, Va.

[73] Assignee: E. I. Du Pont de Nemours and Company, Wilmington, Del.

[21] Appl. No.: 973,439

[22] Filed: Nov. 9, 1992

[51] Int. Cl.[5] ..... D21H 13/10

[52] U.S. Cl. ..... 162/146; 162/149; 162/158; 162/164.1; 162/206

[58] Field of Search ..... 162/141, 146, 149, 158, 162/164.1, 206

[56] References Cited

U.S. PATENT DOCUMENTS

| | | | |
|---|---|---|---|
| 3,169,899 | 2/1965 | Steuber | 161/72 |
| 3,920,508 | 11/1975 | Yonemori | 162/157 R |
| 4,608,089 | 8/1986 | Gale et al. | 106/90 |
| 4,783,507 | 11/1988 | Tokunga et al. | 525/240 |
| 5,000,824 | 3/1991 | Gale et al. | 162/157.5 |
| 5,013,599 | 5/1991 | Guckert et al. | 428/286 |
| 5,047,121 | 9/1991 | Kochar | 162/146 |
| 5,133,835 | 7/1992 | Goettmann et al. | 162/146 |

OTHER PUBLICATIONS

Kirk-Othmer: Encyclopedia of Chemical Technology, vol. 19, 3rd edition, John Wiley & Sons, pp. 420–435 (1982).

*Primary Examiner*—James J. Bell

[57] ABSTRACT

A process for producing high grade polyethylene paper on conventional continuous wet-lay papermaking equipment. In particular, the process comprises preparing a furnish of 75–99 wt. % oriented polyethylene pulp, 0.5–15 wt. % fibrous stabilizing agent and 0.5–10 wt. % strengthening agent and depositing the furnish on the forming screen of a conventional wet-lay papermaking machine. The resulting waterleaf sheet is dried on heated drying cans and then thermally bonded to provide a high grade polyethylene paper having high dry strength and toughness, exceptional dimensional stability and superior uniformity (i.e., no holes). The high grade polyethylene paper made by the inventive process is particularly useful in microfiltration end-uses such as vacuum cleaner bags.

18 Claims, 1 Drawing Sheet

HIGH GRADE POLYETHYLENE PAPER

FIELD OF THE INVENTION

The present invention relates to a process for making high grade polyethylene paper and products produced thereby. In particular, the invention relates to a process for producing high grade polyethylene paper from a furnish of polyethylene pulp, a fibrous stabilizing agent and a strengthening agent on conventional continuous wet-lay papermaking equipment.

BACKGROUND OF THE INVENTION

Spunbonded fibrous sheets made of multiple plexifilamentary strands of oriented polyethylene film fibrils are disclosed in U.S. Pat. No. 3,169,899 (Steuber). Such sheets are produced commercially by E. I. du Pont de Nemours and Company under the trademark "TYVEK" spunbonded olefin. These sheets have proven useful in diverse applications which take advantage of the sheet's unusually good combination of strength, tear resistance and permeability properties. Often, polyethylene pulps are prepared by cutting up precursor sheets (i.e., unbonded plexifilamentary sheets) into small pieces and beating the cut pieces in an aqueous pulp refiner. Examples of prior art methods for producing such pulps include:

*Kirk-Othmer: Encyclopedia of Chemical Technology*, Vol. 19, 3rd edition, John Wiley & Sons, pp. 420–435 (1982) which describes synthetic pulps as generally being very fine, highly branched, discontinuous, water-dispersible fibers made of plastics. Methods are described for producing synthetic pulps by solution flash-spinning, emulsion flash-spinning, melt-extrusion/fibrillation and shear precipitation. The pulps may be blended with other fibers in an attempt to make papers, sheets or boards by conventional wet-lay papermaking techniques. Such pulps are also identified as being used as bonding agents for certain nonwoven materials such as dry-laid, Rando-Webber formed sheets and wet-laid, Fourdrinier-formed sheets.

U.S. Pat. No. 4,608,089 (Gale et al.) which discloses forming oriented polyethylene film-fibril pulps by cutting flash-spun polyethylene plexifilamentary strands into pieces, forming an aqueous slurry with the pieces and then refining the pieces with disc refiners to form a pulp that is particularly well suited for cement reinforcement. The pulp is prepared from flash-spun plexifilaments which are cut into small pieces and beaten in an aqueous medium. Although these pulps have found some utility in reinforcing cement composites, they are not useful in making high grade polyethylene paper.

U.S. Pat. No. 5,000,824 (Gale et al.) discloses forming improved oriented polyethylene film-fibril pulps for reinforcing various articles. The pulps are prepared from flash-spun, oriented, linear polyethylene, plexifilamentary strands that are converted into small fibrous pieces that are then reduced in length by refining in an aqueous medium to form a fibrous pulp slurry. The pulp slurry is then further refined until an average fiber length of no greater than 1.2 mm is achieved and no more than 25% of the fibrous pulp is retained on a 14-mesh screen and at least 50% of the pulp passes through the 14-mesh screen but is retained by a 100-mesh screen. Various articles are disclosed which can be made from the improved pulp. These include, speciality synthetic papers, reinforced gaskets, reinforced cements, reinforced resinous articles and heat-bonded sheets. Although these pulps have found some utility in reinforcing applications and in producing crude paper hand sheets, they are not useful in making high grade, low basis weight polyethylene paper on conventional continuous wet-lay paper-making equipment.

Some of the problems encountered when trying to make high grade polyethylene paper on conventional continuous paper-making equipment with these types of polyethylene pulps include (1) the pulp tends to stick to the drying surfaces while the paper is being dried and (2) the dried paper tends to tear when handled due to low dry strength caused by inadequate heat fusing. Moreover, during the drying process the sheet may elongate in the machine direction and hang in between the drying surfaces. These problems cause the resulting paper sheet to have low dry strength and poor uniformity (e.g., holes and blotchiness). Although there are some methods available which allow synthetic paper to be made from polyethylene pulp on conventional paper-making equipment, they require unique fibers and process steps. One such example is disclosed in U.S. Pat. No. 4,783,507 (Tokunaga et al.), where the inventive feature rests in the use of two polyethylene pulps, one that melts at 95 C. or below and one that melts at higher temperatures. Paper can be prepared from the two polyethylene pulps on a conventional paper-making machine using drying cans which are heated by 100 C. steam. The polyethylene pulps used to make such paper are prepared by the process of U.S. Pat. No. 3,920,508 (Yonemori) wherein flash-spinning takes place using an emulsion of polyethylene in a solvent of polyvinyl alcohol and water.

In an attempt to minimize sticking and elongation difficulties, a particular method has been disclosed in U.S. Pat. No. 5,047,121 (Kochar). Kochar teaches a process for making high grade polyethylene paper containing at least 97 wt. % polyethylene fibrids on continuous wet-lay papermaking equipment. A pulp furnish of oriented polyethylene fibrids and polyvinyl alcohol fibers are deposited on a forming screen to make a waterleaf sheet. The sheet is dried on drying cans using a very particular drying profile to help reduce sticking and elongation. The sheet is thereafter thermally bonded to provide a polyethylene paper having generally high strength, low defects and good uniformity.

Although the teachings of Kochar have been successful for making high grade polyethylene paper, there are still several processing and quality problems associated with its use. Experience has shown that unless the drying profile is carefully controlled and the drying cans are routinely cleaned, sticking, tearing and stretching can still be significant problems. Also, if a non-permanent release agent is used on the drying cans (e.g., PTFE particles in an oil dispersion), holes will occur in the resulting sheet if the oil-based release agent drips on the sheet as it passes along the drying cans. Because of the nature of the pulp material making up the sheet, ⅛ to ½ inch (0.3 to 1.3 cm) holes often appear in the resulting sheet following thermal bonding. These holes typically occur during bonding due to fiber shrinkage caused by agglomerates, pills and/or dirt particles that may be present in the wet-laid sheet. Typically, polyethylene pulps with greater than about 2% defects (i.e., agglomerates or pills manifesting themselves as entanglements of pulp fiber) greatly contribute to holes. Moreover, if there is not enough heat to cause the pulp to fuse together or the pulp was too short, the dry strength of the polyethylene paper is significantly compromised. These problems are especially undesirable in end-use applications (e.g., vacuum cleaner bags) where strength, uniformity and porosity must be carefully controlled.

Clearly, what is needed is a process for producing high grade polyethylene paper from polyethylene pulp on conventional continuous wet-lay paper-making equipment wherein the process and the paper produced thereby do not have the deficiencies inherent in the prior art. The paper should have increased dimensional stability, high strength and superior uniformity (i.e., a very low number of defects such as holes, pills or agglomerates) so that it can be successfully used in critical end-use applications such as microfiltration. Other objects and advantages of the present invention will become apparent to those skilled in the art upon reference to the drawings and the detailed description of the invention which hereinafter follows.

SUMMARY OF THE INVENTION

In one aspect, the present invention is directed to a process for preparing a high grade polyethylene paper on conventional continuous wet-lay paper-making equipment. The process comprises the steps of:

(a) preparing a pulp furnish comprising:
  (i) 75–99 wt. % polyethylene pulp having a birefringence of at least about 0.030, an average length of at least about 0.7 mm, a defect level of between 0 to 6%, and a coarseness of no greater than about 0.23 mg/m; and
  (ii) 0.5–15.0 wt. % of a fibrous stabilizing agent having an average fiber length of at least about 2.9 mm and a coarseness of no greater than about 0.23 mg/m; and
  (iii) 0.5–10.0 wt. % of a strengthening agent;
(b) depositing the pulp furnish on a forming screen of a wet-lay paper-making machine to form a waterleaf sheet;
(c) drying the resulting waterleaf sheet on a series of heated drying cans; and
(d) thermally bonding the dried sheet at a temperature between 250–315 F. to provide a high grade paper having a Frazier porosity of at least 2 $ft^3/ft^2/min$ at 0.5 inches of water pressure drop, preferably at least 4 $ft^3/ft^2/min$ at 0.5 inches of water pressure drop.

Preferably, the polyethylene pulp is present from about 80–99 wt. %, the fibrous stabilizing agent is present from about 0.5–10.0 wt. % and the strengthening agent is present from about 0.5–10.0 wt. %. Most preferably, the polyethylene pulp is present at about 90 wt. %, the fibrous stabilizing agent is present at about 5.0 wt. %, and the strengthening agent is present at about 5.0 wt. %.

The critical step of the papermaking process involves blending a small amount of a fibrous stabilizing agent and a small amount of a strengthening agent with the polyethylene pulp. The result of the process is a high grade polyethylene paper which has high dry strength and toughness, increased dimensional stability, and superior uniformity (e.g., no holes). The resulting paper generally has a basis weight of between 1.5 to 4.5 oz./$yd^2$ and is particularly useful in microfiltration applications (e.g., vacuum cleaner bags) and in making battery separators.

The applicants' inventive process permits high grade polyethylene paper to be produced without the need for particular drying temperature profiles or drying can release agents. In fact, many different drying profiles may be used without danger of the polyethylene pulp sticking to the drying can surfaces. Moreover, dirt, agglomerates and pills that may be present in the wet-laid sheet will not cause holes when the sheet is thermally bonded. Due to the reduced sensitivity of defects in the polyethylene pulp, acceptable paper sheets can be produced with polyethylene pulp containing up to 6% defects. Because of this, the sheets have superior uniformity, increased dimensional stability, high strength and toughness for handling (e.g., rewinding). In commercial terms, this means that high grade polyethylene paper can be made for long periods of time on continuous wet-lay papermaking equipment without rewindability problems due to paper tearing or breaking.

BRIEF DESCRIPTION OF THE DRAWINGS

The invention will be better understood with reference to the following figures.

DETAILED DESCRIPTION OF THE PREFERRED EMBODIMENTS

Figure 1:
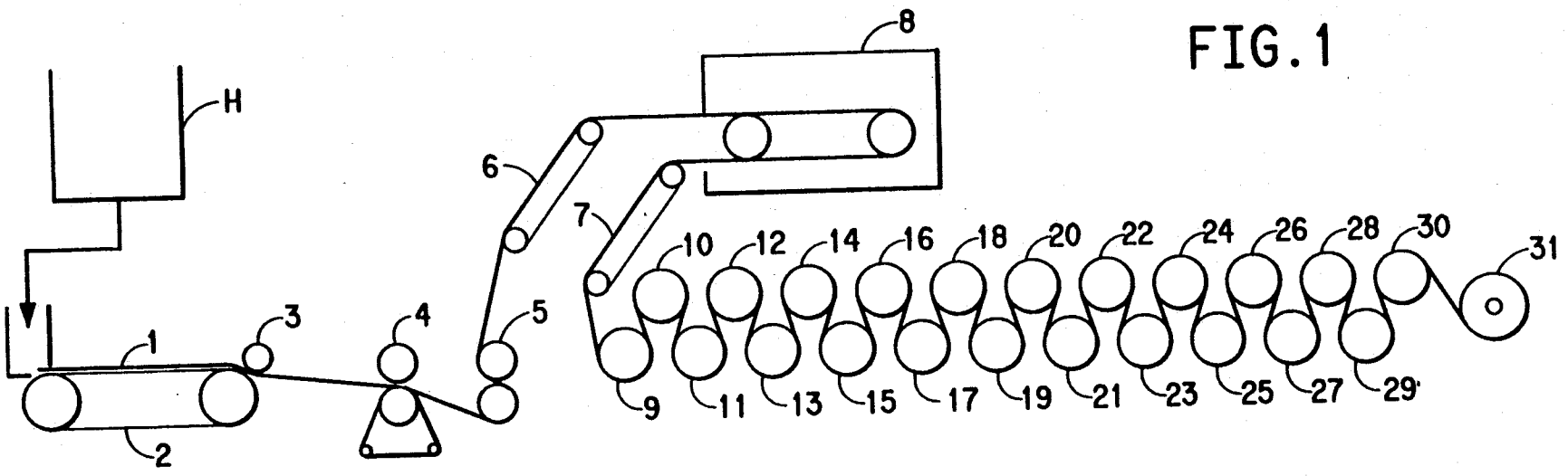
FIG. 1 shows a schematic view of a conventional wet-lay Foudrinier paper-making machine wherein a wet-laid layer of fibrous pulp 1 from a head box H is advanced on a forming wire 2 to a dewatering press section (rolls 3–5), then through a pre-drying section 8 (between conveyors 6 and 7), then through a drying section (drying cans 9–30), and finally to a windup to form roll 31 of high grade polyethylene paper.

As used herein, the term "fibrous stabilizing agent" means a fibrous material added to the polyethylene pulp which tends to stabilize the paper sheet and prevent holes from forming in the sheet. The stabilizing agent gives dimensional stability to the sheet when the highly oriented polyethylene pulp within the sheet is heated during drying and bonding operations. These fibrous materials must themselves not shrink during drying or bonding and must have a melting point substantially higher than that of the polyethylene pulp. The fibrous stabilizing agent must provide a uniform distribution and form a fiber matrix network with the polyethylene pulp. It has been determined that the fibrous stabilizing agent should have an average fiber length of at least about 2.9 mm and a coarseness of no greater than about 0.23 mg/m. Preferable fibrous stabilizing agents include northern softwood kraft woodpulps, microglass fibers and polyester fibers. Particularly preferred is a northern softwood bleached kraft woodpulp commercially available from James River Corporation as "Marathon Softwood" woodpulp.

As used herein, the term "strengthening agent" means a material added to the polyethylene pulp which tends to add dry strength and toughness to the paper sheet without affecting filtration performance. These materials are unique in that they will bond the fibrous stabilizing agent and the polyethylene pulp together. Because of this bonding, the tendency of the polyethylene pulp fibers to stick to the drying can surfaces is minimized. Presently preferred strengthening agents include Hycar 2671 acrylic latex commercially available from B. F. Goodrich Corporation and "Polywax" 655 T60 commercially available from Petrolite Corporation. Other suitable strengthening agents include Rhoplex acrylic latexes (e.g., NW 1715, E 32, E 1845 and LC 40) commercially from Rohm & Haas and Sequa acrylic latexes (e.g., FVAC and 3033-124) commercially available from Sequa Chemicals.

As used herein, "white water" means a dilute suspension of fine materials which pass through the forming wire and are recovered from the forming process.

As used herein, the terms "agglomerate" and "pill" mean a defect that manifests itself as poorly dispersed clumps of fibers in the paper sheet.

As used herein, "stick point" or "sticking point" means the temperature at which the drying surfaces are hot enough to cause surface polyethylene pulp fibers to stick or attach to the drying surface. This is the point where adhesion causes the polyethylene pulp fibers to stick to the can surfaces and the force is great enough to pull pulp fibers out of the paper sheet. It should be noted that sticking will not necessarily occur instantly and may only become apparent over a period of time as fibers build up on the drying surface.

One process for preparing polyethylene pulp suitable for use in the above-described paper-making process involves the same steps as used in preparing the fibrous pulps of Gale et al. in U.S. Pat. No. 5,000,824, the entire contents of which are incorporated herein by reference. Basically, the steps include flash-spinning a linear polyethylene polymer into interconnected strands of oriented plexifilaments having a birefringence of at least 0.030 and converting the strands into small pieces that are then reduced in size by refining in an aqueous medium to form a fibrous polyethylene pulp slurry. Equipment suitable for performing the refining step is described in more detail in U.S. Pat. No. 4,608,089 (Gale et al.), the entire contents of which are incorporated herein by reference.

Another process for preparing polyethylene pulp suitable for use in the invention involves making the polyethylene pulp more wettable. In this case, high density, flash-spun polyethylene pulp of the type described in U.S. Pat. No. 5,047,121 (Kochar), the entire contents of which are incorporated herein by reference, are slurried in a pulper at a 1.7 wt. % consistency. A partially hydrolyzed form of poly vinyl alcohol (PVA powder) is added as a wetting agent at 1.25% by weight of the polyethylene pulp and a small amount (1 gal. per 5,000 gal. of water) of an anti-foam (e.g., Sandoz antimussol KBG anti-foam) is added. White water returned to the pulper contains residual amounts of a surfactant (e.g., polyoxyethylene (20) sorbitan monolaurate commercially available from ICI Americas, Inc. under the tradename "Tween 20"). The surfactant improves the wetting characteristics of the polyethylene pulp. The slurry is refined with single disk refiners operating at tightly controlled flow rate, high rotational speed and a refiner plate gap of less than 10 mils.

The polyethylene pulp/water mixture is then further wetted out by adding 1% of a surfactant such as "Tween 20" by polyethylene pulp weight downstream of the disk refiners. Pulp length is optimized by light power (less than 20% of total power) from additional refining and defects are screened out, refined and returned to the main slurry. The resultant mixture is dewatered to greater than 60 wt. % solids. (This type of wetted polyethylene pulp is referred to hereinafter as DP700 polyethylene pulp).

The resultant polyethylene pulp made by either of these pulp making processes is characterized by a birefringence of at least 0.030, an average length of at least about 0.7 mm (preferably between about 0.85 and 1.15 mm), a defect level of between 0 and 6% (preferably between 0 and 4%), and a coarseness of no greater than about 0.23 mg/m (preferably between about 0.10 and 0.20 mg/m).

From either of these polyethylene pulps high grade polyethylene paper can be made. The paper can be produced by (1) first producing the polyethylene pulp and then reslurrying the polyethylene pulp with other ingredients to form the paper or (2) the paper can be produced by refining the pulp from polyethylene feedstock, adding the fibrous stabilizing agent and strengthening agent after the primary refining of the feedstock and then forming the paper as part of a continuous process.

In either case, the paper must contain a fibrous stabilizing agent preferably from about 0.5–10 wt. %, most preferably about 5 wt. %, that serves to reduce paper shrinkage during thermal bonding. It must also contain a strengthening agent preferably from about 0.5–10 wt. %, most preferably about 5 wt. %, to give the paper sheet dry processing strength during rewinding and handling prior to thermal bonding. Both of these agents are typically added to the pulp slurry downstream of the primary pulp refining equipment.

In the preferred composition, the fibrous stabilizing agent is a northern softwood bleached kraft woodpulp having an average fiber length of at least about 2.9 mm and a coarseness of no greater than about 0.23 mg/m. This woodpulp can be opened and dispersed in a pulper either with polyethylene pulp at 5 wt. % loading or by itself.

In the preferred composition, the strengthening agent is either Hycar 2671 acrylic latex or "Polywax" 655 T60 low density polyethylene powder (More specific details on this unique polyethylene powder are disclosed in U.S. Pat. No. 4,783,507). Preferably, these strengthening agents should not be refined directly with the polyethylene pulp.

In the preferred method, the latex is added to the polyethylene pulp/woodpulp slurry at a controlled pH of between 8–9. Normally, a small amount of soda ash is added to raise the pH to this level (25–50 ppm) depending on the percent of white water present in the slurry. Normally, a papermaker's alum solution is then used under controlled pH to precipitate out the latex. These alum solutions are well known to those skilled in the papermaking art. During the precipitation process, white water must be controlled to avoid eliminating the benefits of the latex.

If "Polywax 655 T60" is used, the method is more convenient since there is no concern for pH control, precipitation rate, or white water reuse effects. Dispersion of the hydrophobic "Polywax 655 T60" powder is the only real concern. One of many methods available for maintaining the dispersion calls for prewetting slurries of 2–5 wt. % "Polywax 655 T60" in water with a surfactant such as "Tween 20".

Optional additional adjuvants (e.g., anti-foams) may also be added to the furnish (up to 2 wt. %) to help in processing the furnish, but these are not essential to the invention. Experience has shown that during processing most of the adjuvants get washed away during dewatering operations (i.e., wet pressing).

In preparing the final furnish, the polyethylene pulp, the fibrous stabilizing agent and the strengthening agent are uniformly dispersed in water to about a 3 wt. % solids consistency. The furnish is then further diluted with water to about a 0.5 wt. % solids consistency.

The furnish is then deposited on the forming screen of a conventional wet-lay paper-making machine (e.g., Fourdrinier machine). A small amount of an anti-foam (e.g., Sandoz anti-mussol KBG anti-foam) can be added at the headbox H to control foaming. The furnish is dewatered by wet pressing to form a waterleaf sheet. Wet pressing the sheet stabilizes the non-wire surface and reduces the possibility of fibers pulling out of the sheet and depositing on the hot drying cans. Absorbent fabric sleeve material (e.g., wool) on the press rolls and/or felted wet pressing improves the stabilizing effect of pressing on the non-wire surface.

Impingement hot air dryer preheating of the sheet is preferably used to remove additional water after wet pressing and before the sheet enters the series of steam heated drying cans. Preheating helps reduce the steam pressure required for final drying to a level which is below the sticking point of the polyethylene pulp. Pre-drying, along with the strengthening agent (e.g., acrylic latex or "Polywax 655 T60") allows sufficient dry strength to be developed within the sheet for rewinding without having to heat the sheet above its sticking point.

Thereafter, the partially dried waterleaf sheet is completely dried across a series of heated drying cans. The drying cans can have many different drying temperature profiles without danger of having the polyethylene pulp stick to the drying can surfaces. Because the drying temperature profile is not critical, processing times can be significantly reduced compared to those of the prior art (i.e., the process of Kochar). A typical paper drying section with multiple steam heated cans (cans 9–28) and cooling cans (cans 29–30) is shown in FIG. 1 and used to complete drying, stabilize the sheet and provide dry sheet strength. It is particularly preferred to use non-felted cans during the early drying zone where the sheet is still wet to avoid fiber deposits on the cans. The final cans should be cooled to about 110–130 F. to stabilize the sheet and prevent sheet shrinkage. If this is not done, the edges will have a tendency to curl and initiate edge tears. Otherwise, the entire bank of cans (cans 9–28) can be controlled to full pressure (i.e., the pressure just under the sticking point); non-contacting infrared temperature measurements of the can surfaces near the edges average 245–255 F. for 28 psig steam.

Lastly, the dried sheet is thermally bonded at a temperature between 240–315 F. to provide high grade polyethylene paper having a Frazier porosity of at least 2 $ft^3/ft^2/min$ at 0.5 inches of water pressure drop, preferably at least 4 $ft^3/ft^2/min$ at 0.5 inches of water pressure drop. The porosity of the paper may be tailored to a specific application by passing the sheet through a small roll bonder and modifying the bonding temperature. During bonding, the sheet is typically held in place by electrostatic and/or pressure means to minimize sheet shrinkage. Following bonding, the paper is wound up in roll form for purposes of storage and transportation.

The resulting high grade polyethylene paper can be made with up to 6% defects and still be used effectively in sensitive filtration applications. This is unlike the prior art (Kochar) where defect levels typically above 2% resulted in paper sheets unsuitable for filtration applications (i.e., paper with holes).

The invention will be more readily understood by referring to the attached drawings, which are schematic representations of equipment suitable for making high grade polyethylene paper according to the invention. Other possible configurations are possible and these depicted arrangements are not critical or essential to the invention.

FIG. 1 shows a typical Foudrinier machine wherein a wet-laid layer of furnish fibers 1 is supplied from a headbox H and floated on a forming screen 2. The furnish is advanced through a wet press section (rolls 3–5) to dewater the furnish. Rolls 3–5 are primarily for wet pressing. The resulting waterleaf is passed through a pre-drying section (hot air impingement pre-dryer 8 between entrance conveyor 6 and exit conveyor 7). The partially dried waterleaf sheet is then advanced through a drying section over a series of steam heated drying cans (cans 9–30). It will be understood that the exact number of drying cans is not critical to the invention and a matter of choice to those skilled in the papermaking art. Preferably, drying cans 20, 22, 24, 26, 28 and 30 are all felted (all the others are unfelted) and the last two drying cans (cans 29 and 30) are used to cool the paper sheet to stabilize the sheet and prevent sheet shrinkage before, during and after wind up on roll 31.

Figure 2:
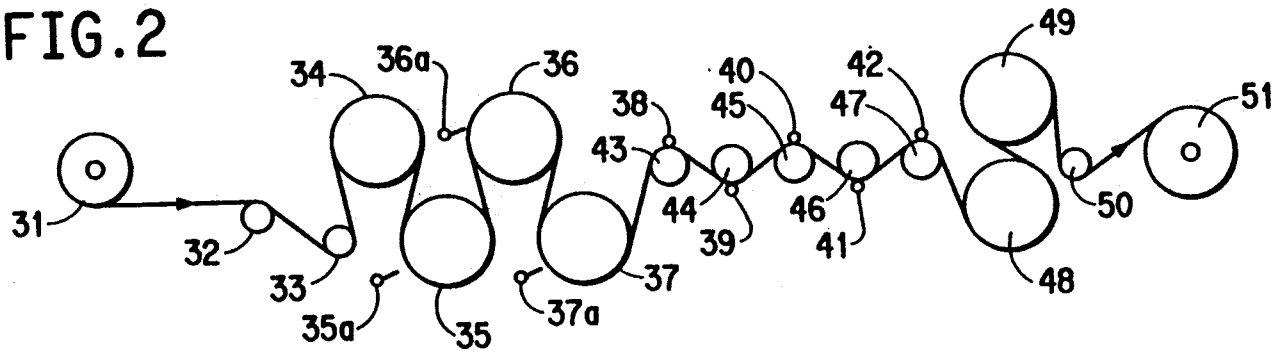
FIG. 2 shows a schematic view of a small roll bonder used to thermally bond the dried sheet of FIG. 1.

As shown in FIG. 2, the bonding of the sheet can be accomplished with conventional equipment, such as a small roll bonder. In use, the dried paper sheet is unwound and advanced over a bowed roll 32 and under idler roll 33. Thereafter, the sheet is passed over a series of preheating rolls (24 inch diameter preheat rolls 34–37). Electrostatic charging takes place at rolls 35, 36 and 37 using ion guns **35*a*, 36*a* and 37*a*. Thereafter, the sheet is passed between a series of rubber covered nip rolls (rolls 38–42) and corresponding bonding rolls (8 inch diameter bonding rolls 43–47). Lastly, the sheet is passed over a series of chilled rolls (24 inch diameter chilled rolls 48–49) and under idler roll 50 to windup roll 51**.

For the bonding operation, all rolls are operated at substantially the same peripheral speeds. The bonding temperature is maintained between 240–315 F. to provide a Frazier porosity of at least 2 $ft^3/ft^2/min$ at 0.5 inches of water pressure drop, preferably at least 4 $ft^3/ft^2/min$ at 0.5 inches of water pressure drop. As noted above, the temperature may be varied within this range to produce paper of a particular porosity depending on the specific end-use application desired.

The various characteristics referred to herein for the pulps and paper made from them are measured by the following test methods. In the description of the methods, ASTM refers to the American Society of Testing Materials, TAPPI refers to the Technical Association of Paper and Pulp Industry and ISO refers to the International Organization for Standardization.

Fiber length and coarseness are determined by the Kajaani optical test method commonly used in the paper industry. Average fiber length is measured by a Kajaani FS-200 apparatus having an approximate orifice diameter of 0.4 mm. The apparatus is used to sample a pulp fiber population and provide a length distribution. The total number of fibers are counted and a number and weighted length distribution and a coarseness are calculated from this data.

Birefringence is measured by the technique provided in detail in U.S. Pat. No. 4,608,089 (Gale et al.), column 2, line 64 through column 3, line 33, which specific disclosure is incorporated herein by reference.

Opacity of a dried water-laid paper is measured with a Technidyne Micro TB1 C testing instrument (manufactured by Technidyne Corporation of New Albany, Ind.) which conforms with ISO Standards 2469 and 2471 and TAPPI T519 for measurements of diffuse opacity. The determinations are made in accordance with procedures published by Technidyne, "Measurement and Control of the Optical Properties of Paper" (1983) and in particular employ diffuse geometry with a Position B filter which has a 457 nm effective wavelength. The determinations are analyzed statistically to provide the average opacity and its variance for sheets of a given pulp. A small variance of opacity indicates the ability of a pulp to form uniform, non-blotchy synthetic pulp sheet.

Frazier porosity is measured in accordance with ASTM D 737-46 and is reported in cubic feet per square feet per minute at 0.5 inches of water pressure drop. Drainage (commonly known as Canadian Standard Freeness [CSF]) is measured in accordance with TAPPI T-227 test method and is reported in milliliters (ml).

Defects are measured by use of a Pulmac Shive Analyzer of the type commonly used in the paper industry. A water slurry of the pulp flows into a beater chamber that contains a metal plate containing narrow slits (4 mils by 3 inches are typical). The pulp that does not pass through the slits is captured, dried and weighed. This weight is calculated to % defects.

EXAMPLES

In the non-limiting Examples which follow, all percentages and ratios of composition ingredients are by total weight of the composition, unless indicated otherwise. It will be understood that there may be many other suitable fibrous stabilizing agents or strengthening agents in addition to the acceptable ones identified below.

EXAMPLE 1

In this example, the effects of various fibrous stabilizing agents were evaluated when used with a wettable polyethylene pulp (DP700) and an acrylic latex strengthening agent (Hycar 2671 acrylic latex from B. F. Goodrich, Corp.) for. sensitive filtration end-uses (e.g., vacuum cleaner bags). Bonded paper samples were made at a basis weight of about 2.0 oz/yd$^2$. The fibrous stabilizing agent was loaded at a 5 wt. % level and the acrylic latex was loaded at 5 a wt. % level. All samples were bonded in an oven at 134 C. for 10 minutes. As a control, a paper sample was also made out of DP700 polyethylene pulp without any fibrous stabilizing agent or strengthening agent. The results are provided in Table 1 below. In the Table, a heat stability index (HSI) is indicated to roughly quantify the effects of bonding. In this Table, a rating of 1-10 (poor-good) was given to each sample. Strip tensile strength is reported in lbs per linear inch and elongation is reported as a percentage.

TABLE 1

| Sample | Ave. Length | Fiber Coarseness | Un-bonded Tensile | Sheet Specs Elongation | HSI |
|---|---|---|---|---|---|
| DP700 | — | — | 0.22 | 1.6 | 1 |
| WOOD | 2.9 mm | 0.14 mg/m | 0.37 | 1.98 | 6 |
| LAT | — | — | 0.43 | 5.72 | 1 |
| MAR | 2.9 mm | 0.14 mg/m | 0.76 | 7.38 | 8 |
| CS | 1.5 mm | 0.13 mg/m | 0.70 | 8.86 | 3 |
| CL | 2.8 mm | 0.23 mg/m | 0.73 | 8.56 | 3 |
| HS | 2.9 mm | 0.17 mg/m | 0.76 | 7.72 | 8 |
| IC | 2.9 mm | 0.18 mg/m | 0.73 | 6.81 | 5 |
| CA | 6.4 mm | 0.18 mg/m | 0.72 | 9.73 | 3 |

TABLE 1-continued

| Sample | Ave. Length | Fiber Coarseness | Un-bonded Tensile | Sheet Specs Elongation | HSI |
|---|---|---|---|---|---|
| EG | — | <0.10 mg/m | 0.67 | 10.07 | 9 |
| CG | 6.4 mm | 0.12 mg/m | 0.70 | 6.12 | 8 |
| PP | 5.0 mm | 0.24 mg/m | 0.72 | 6.93 | 3 |
| PE | 6.4 mm | 0.44 mg/m | 0.64 | 8.02 | 1 |
| N | 6.4 mm | 0.33 mg/m | 0.62 | 7.88 | 2 |
| PET-1 | 12.7 mm | 0.17 mg/m | 0.79 | 6.09 | 7 |
| PET-2 | 12.7 mm | 0.67 mg/m | 0.68 | 8.88 | 6 |
| PET-3 | 6.4 mm | 0.67 mg/m | 0.73 | 7.54 | 3 |
| SS | 6.4 mm | 0.40 mg/m | 0.71 | 8.25 | 3 |

DP700 = polyethylene pulp with no latex and no fibrous stabilizing agent (Control 1)
WOOD = 95 wt. % DP700 PE pulp, 5 wt. % Marathon woodpulp, no latex
LAT = 95 wt. % DP700 PE pulp, 5 wt. % latex, no fibrous stabilizing agent
MAR = Marathon northern softwood bleached kraft woodpulp (Control 2)
CS = Chesapeake Southern Hardwood woodpulp
CL = Southern Cellulose Grade 286 Cotton Linters
HS = Howe Sound 400 - Red Cedar/White Spruce kraft woodpulp
IC = Intercontinental - White Spruce/Lodgepole Pine kraft woodpulp
CA = Cellulose Acetate
EG = Evanite Grade 406 Microglass
CG = Corning Glass
PP = Hercules Herculon Polypropylene
PE = Polyethylene
N = Nylon
PET-1 = Polyester
PET-2 = Polyester
PET-3 = Polyester
SS = Stainless Steel The heat stability index rating shows that of the samples tested, Marathon northern softwood bleached kraft woodpulp (MAR), red cedar/white spruce woodpulp (HS), white spruce/lodgepole pine woodpulp (IC), microglass fibers (EG and CG) and polyester fibers (PET-1) are suitable fibrous stabilizing agents when used with polyethylene pulp and an acrylic latex strengthening agent (an HSI rating of 5 or higher is considered acceptable for making sheets useful in sensitive filtration applications, although a rating or 7 or higher is most preferred). (It should be noted that although the WOOD sample has an acceptable heat stability index, it does not possess adequate strength for sheet rewinding due to the absence of a strengthening agent (e.g. latex)). This sort of fibrous stabilizing agent will act as a heat stable matrix which will mechanically keep the polyethylene pulp from forming holes during the bonding process yet will not affect the filtration and processing characteristics of the ultimate paper sheet. The heat stability index basically rates the ability of a sheet to hold its shape without shrinkage and prevent holes from forming during thermal bonding in an oven for 10 minutes at 134 C.

This example demonstrates that there are ways of characterizing fibrous stabilizing agent acceptability based on a relationship between average fiber length and coarseness.

EXAMPLE 2

In this example, 2.0 oz/yd$^2$ unbonded paper samples were made according to the invention and compared to unbonded samples made by U.S. Pat. No. 5,047,121 (Kochar). The unbonded Kochar paper (i.e., P800) had a composition of 98 wt. % polyethylene pulp and 2 wt. % polyvinyl alcohol fibers. The inventive samples had a composition of (1) 90 wt. % polyethylene pulp, 5 wt. % "Marathon" woodpulp and 5 wt. % Hycar 2671 acrylic latex (i.e., T810) and (2) 90 wt. % polyethylene pulp, 5 wt. % "Marathon" woodpulp and 5 wt. % "Polywax 655 T60" (i.e., P820). The results are set forth in Table 2 below. In the Table, strip tensile strength is reported in lbs per linear inch, elongation is reported as a percentage and work-to-break is reported in in-lbs.

TABLE 2

| | P800* | | | P810** | | P820** | |
|---|---|---|---|---|---|---|---|
| | 1 | 2 | 3 | 1 | 2 | 1 | 2 |
| MD Tensile | 3.64 | 4.07 | 1.98 | 1.23 | 2.58 | 2.69 | 1.80 |
| CD Tensile | 1.97 | 2.04 | 1.11 | 0.54 | 1.40 | 1.22 | 0.95 |
| MD Elong. | 1.12 | 1.26 | 0.87 | 1.38 | 1.22 | 0.94 | 0.85 |
| CD Elong. | 2.02 | 1.93 | 1.32 | 2.51 | 1.87 | 1.58 | 1.48 |
| MD Work To Break | 0.12 | 0.14 | 0.05 | 0.06 | 0.09 | 0.08 | 0.04 |
| CD Work To Break | 0.13 | 0.13 | 0.05 | 0.05 | 0.09 | 0.06 | 0.04 |

*Unbonded sheet was dried at conditions above the stick point of the polyethylene pulp (steam pressure 32–35 psig)
**Unbonded sheet was dried at conditions below the stick point of the polyethylene pulp (steam pressure 28 psig)

In this example, the steam drying pressure was between 32–35 psig for P800 and 28 psig for P810 and P820. This example demonstrates that comparable sheet strengths are obtained for P810 and P820 compared to P800 even though the drying conditions were different. The use of a strengthening agent allows the P810 and P820 sheet to be dried at conditions below the stick point of the polyethylene pulp. As a result, sticking is avoided without sacrificing the sheet strength necessary for rewinding and handling (i.e., sheet breaking).

EXAMPLE 3

In this example, paper samples were made according to the invention using different strengthening agents and compared to a sample made by the Kochar patent. The Kochar paper had the same composition as in Example 2. The inventive samples had the same composition as in Example 2 except that the strengthening agent was varied to see the effect it had on dry sheet strength. All samples but the last were dried at 20 psig steam pressure. Frazier porosity is reported as $ft^3/ft^2/min$ at 0.5 inches of water pressure drop. Basis weight is in lb/ream. Strip tensile strengths are in lbs/linear inch and elongation is reported as a percentage.

TABLE 3

| Sample | Frazier Porosity | Basis Weight | MD Strip Tensile | % MD Elong. | CD Strip Tensile | % CD Elong. |
|---|---|---|---|---|---|---|
| Kochar* | 3.25 | 40.3 | 1.62 | 2.38 | 0.59 | 7.01 |
| 2671* | 5.45 | 43.9 | 3.26 | 2.69 | 1.37 | 6.85 |
| Acrylic Latex 2671 | 5.48 | 43.6 | 1.62 | 2.38 | 0.59 | 7.01 |
| Acrylic Latex Polywax 655 T60 | 6.38 | 41.60 | 1.84 | 2.22 | 0.98 | 5.92 |
| Polywax 655 T60** | 6.26 | 44.30 | 4.73 | 2.68 | 2.59 | 6.37 |

*These samples were made at a different time than the remaining samples although on the same equipment. The drying took place at a steam pressure of 20 psig which is below the stick point for the polyethylene pulp.
**This sample was dried at a higher temperature (28 psig steam pressure) to improve the strength characteristics of the sheet. This is still below the stick point of the polyethylene pulp.

This Table shows that at the same drying conditions there is an improvement in dry strength when strengthening agents are used according to the invention as opposed to the strength of paper made according to the prior art (Kochar). Thus, the inventive process can be run at lower drying temperatures than that of the prior art, although comparable strength paper can still be obtained. As also demonstrated in Example 2, this means that when strengthening agents are used lower steam pressures (e.g. 4–7 psig lower) can be employed instead of the higher steam pressures currently needed to develop satisfactory strength through fiber fusing. This reduction in steam pressure allows the sheet to be dried at conditions below the stick point of the polyethylene pulp.

The applicants have found that the use of 28 psig steam in the drying section provides the best balance of strength (i.e., good rewindability without breaking) without sticking (below the sticking point of the polyethylene pulp). Thus, the Frazier porosity and the strength of the sheet can be tailored for the specific end-use desired.

Although particular embodiments of the present invention have been described in the foregoing description, it will be understood by those skilled in the art that the invention is capable of numerous modifications, substitutions and rearrangements without departing from the spirit or essential attributes of the invention. Reference should be made to the appended claims, rather than to the foregoing specification, as indicating the scope of the invention.

We claim:

1. A process for preparing a high grade polyethylene paper on conventional wet-lay papermaking equipment, comprising the steps of:
   (a) preparing a pulp furnish comprising:
      (i) 75–99 wt. % polyethylene pulp having a birefringence of at least about 0.030, an average length of at least about 0.7 mm, a defect level of between 0 to 6%, and a coarseness of no greater than about 0.23 mg/m;
      (ii) 0.5–15 wt. % of a fibrous stabilizing agent having an average fiber length of at least 2.9 mm and a coarseness of no greater than about 0.23 mg/m; and
      (iii) 0.5–10 wt. % of a strengthening agent;
   (b) depositing the furnish on the screen of a papermaking machine to form a waterleaf sheet;
   (c) drying the waterleaf sheet on a series of heated drying cans; and
   (d) thermally bonding the dried waterleaf sheet at a temperature between 240–315 F. to provide a Frazier porosity of at least about 2 $ft^3/ft^2/min$ at 0.5 inches of water pressure drop.

2. The process of claim 1 wherein the polyethylene pulp is present from about 80–99 wt. %, the fibrous stabilizing agent is present from about 0.5–10 wt. %, and the strengthening agent is present from about 0.5–10 wt. %.

3. The process of claim 1 wherein the polyethylene pulp is present at about 90 wt. %, the fibrous stabilizing agent is present at about 5 wt. %, and the strengthening agent is present at about 5 wt. %.

4. The process according to claim 1 wherein the Frazier porosity is at least 4 $ft^3/ft^2/min$ at 0.5 inches of water pressure drop.

5. The process of claim 1 wherein the polyethylene pulp have a defect level of between 0 and 4%.

6. The process of claim 1 wherein the fibrous stabilizing agent is selected from the group consisting of northern softwood kraft woodpulps, red cedar/white spruce kraft woodpulps, white spruce/lodgepole kraft pine woodpulps, microglass fibers and polyester fibers.

7. The process of claim 1 wherein the strengthening agent is selected from the group consisting of acrylic latexes and low melting polyethylene powders.

8. The process of claim 1 further comprising the steps of wet pressing the waterleaf sheet and pre-drying the waterleaf sheet with impingement hot air before the sheet is dried on the series of heated drying cans.

9. A wet-laid, dried and thermally bonded paper prepared by the process of claim 1.

10. A vacuum cleaner bag fabricated from the wet-laid, dried and thermally bonded paper prepared by the process of claim 1.

11. A high grade polyethylene paper having a Frazier porosity of at least about 2 $ft^3/ft^2/min$ at 0.5 inches of water pressure drop comprising:

(a) 75–99 wt. % polyethylene pulp having a birefringence of at least about 0.030, an average length of at least about 0.7 mm, a defect level of between 0 to 6%, and a coarseness of no greater than about 0.23 mg/m;

(b) 0.5–15 wt. % of a fibrous stabilizing agent having an average fiber length of at least about 2.9 mm and a coarseness of no greater than about 0.23 mg/m; and (c) 0.5–10 wt. % of a strengthening agent.

12. The high grade paper of claim 11 wherein the polyethylene pulp have a defect level of between 0 and 4%.

13. The high grade paper of claim 11 wherein the polyethylene pulp is present from about 80–99 wt. %, the fibrous stabilizing agent is present from about 0.5–10 wt. %, and the strengthening agent is present from about 0.5–10 wt. %.

14. The high grade paper of claim 11 wherein the polyethylene pulp is present at about 90 wt. %, the fibrous stabilizing agent is present at about 5 wt. %, and the strengthening agent is present at about 5 wt. %.

15. The high grade paper of claim 11 wherein the fibrous stabilizing agent is selected from the group consisting of northern softwood kraft woodpulps, red cedar/white spruce kraft woodpulps, white spruce/lodgepole kraft pine woodpulps, microglass fibers and polyester fibers.

16. The high grade paper of claim 11 wherein the strengthening agent is selected from the group consisting of acrylic latexes and low melting polyethylene powders.

17. The high grade paper of claim 11 wherein the Frazier porosity is at least about 4 $ft^3/ft^2/min$ at 0.5 inches of water pressure drop.

18. A vacuum cleaner bag fabricated from the high grade polyethylene paper of claim 11.

* * * * *